US011651719B2

(12) United States Patent
Wetherell et al.

(10) Patent No.: US 11,651,719 B2
(45) Date of Patent: May 16, 2023

(54) ENHANCED SMOOTHNESS DIGITAL-TO-ANALOG CONVERTER INTERPOLATION SYSTEMS AND METHODS

(71) Applicant: Apple Inc., Cupertino, CA (US)

(72) Inventors: John T. Wetherell, San Jose, CA (US); Mahdi Farrokh Baroughi, Santa Clara, CA (US); Jaeyoung Kang, Palo Alto, CA (US); Shingo Hatanaka, San Jose, CA (US); Hasan Akyol, Mountain View, CA (US); Hopil Bae, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/376,131

(22) Filed: Jul. 14, 2021

(65) Prior Publication Data

US 2022/0101772 A1 Mar. 31, 2022

Related U.S. Application Data

(60) Provisional application No. 63/083,687, filed on Sep. 25, 2020.

(51) Int. Cl.
*G09G 3/20* (2006.01)

(52) U.S. Cl.
CPC ... *G09G 3/2007* (2013.01); *G09G 2320/0257* (2013.01); *G09G 2320/0271* (2013.01); *G09G 2320/0673* (2013.01); *G09G 2330/021* (2013.01)

(58) Field of Classification Search
CPC ..... G09G 3/2007; G09G 2320/0257; G09G 2320/0271; G09G 2320/0673; G09G 2330/021
See application file for complete search history.

(56) References Cited

U.S. PATENT DOCUMENTS 7,760,178 B2 * 7/2010 Takada ..... G09G 3/3688 345/77
7,800,562 B2 * 9/2010 Asano ..... G09G 3/3291 345/83
8,120,617 B2 * 2/2012 Tin ..... H04N 1/6019 345/602

(Continued)

*Primary Examiner* — Michael J Jansen, II
(74) *Attorney, Agent, or Firm* — Fletcher Yoder P.C.

(57) ABSTRACT

An electronic device may include an electronic display panel having multiple display pixels for displaying an image based on analog voltage signals. The electronic device may also include interpolation circuitry to generate the analog voltage signals based on digital image data corresponding to the image. The interpolation circuitry may also receive analog reference voltages and interpolate between sets of the analog reference voltages to generate intermediate voltages, which may be a part of the analog voltage signals. Interpolating between the sets analog reference voltages may include performing a first level interpolation of a first set of the analog reference voltages to generate a first intermediate voltage and performing a second level interpolation of a second set of the analog reference voltages to generate a second intermediate voltage, wherein the first level interpolation is different from the second level interpolation.

20 Claims, 7 Drawing Sheets

(56) References Cited

U.S. PATENT DOCUMENTS 8,154,558 B2 * 4/2012 Kuno ..... G09G 5/06 358/1.9
8,493,303 B2 * 7/2013 Furihata ..... G09G 3/3685 345/87
8,823,614 B2 * 9/2014 Lee ..... G09G 3/3233 345/82
8,896,502 B2 * 11/2014 Toyomura ..... G09G 3/3291 345/76
8,963,905 B2 * 2/2015 Cho ..... G09G 3/3685 341/126
9,042,682 B2 * 5/2015 Atkins ..... G06T 3/4007 382/300
10,192,286 B2 * 1/2019 Furihata ..... G06T 3/403
10,600,383 B2 * 3/2020 Song ..... H03F 3/45192
10,916,211 B2 * 2/2021 Nagashima ..... G09G 3/3688
10,978,014 B2 * 4/2021 Yan ..... G09G 3/3233 345/77
11,062,649 B2 * 7/2021 Kim ..... G09G 3/3233 345/82
2006/0087483 A1 * 4/2006 Takada ..... G09G 3/3688 345/89
2006/0164430 A1 * 7/2006 Tin ..... G09G 5/06 345/602
2008/0094425 A1 * 4/2008 Asano ..... G09G 3/3291 345/690
2009/0002354 A1 * 1/2009 Toyomura ..... G09G 3/3291 345/204
2009/0009453 A1 * 1/2009 Furihata ..... G09G 3/3685 345/87
2009/0184974 A1 * 7/2009 Kuno ..... G09G 5/06 345/589
2011/0096054 A1 * 4/2011 Cho ..... G09G 3/3685 345/87
2012/0032995 A1 * 2/2012 Lee ..... G09G 3/3233 345/77
2013/0315505 A1 * 11/2013 Atkins ..... G06T 3/4007 382/300
2016/0078599 A1 * 3/2016 Furihata ..... G06T 3/4007 345/667
2018/0082654 A1 * 3/2018 Song ..... G09G 3/3688
2019/0087620 A1 * 3/2019 Kim ..... G09G 3/20
2020/0013192 A1 * 1/2020 Reinhard ..... H04N 1/6025
2020/0211457 A1 * 7/2020 Kim ..... G09G 3/3233
2020/0234667 A1 * 7/2020 Yan ..... G09G 3/3696
2020/0335054 A1 * 10/2020 Nagashima ..... G09G 3/3688
2021/0056930 A1 * 2/2021 Kang ..... G09G 3/2092
2022/0101772 A1 * 3/2022 Wetherell ..... G09G 3/2007

* cited by examiner

ENHANCED SMOOTHNESS DIGITAL-TO-ANALOG CONVERTER INTERPOLATION SYSTEMS AND METHODS

CROSS-REFERENCE TO RELATED APPLICATIONS

This application claims priority to and the benefit of U.S. Provisional Application No. 63/083,687, entitled "ENHANCED SMOOTHNESS DIGITAL-TO-ANALOG CONVERTER INTERPOLATION SYSTEMS AND METHODS," filed Sep. 25, 2020, the disclosure of which is incorporated by reference in its entirety for all purposes.

SUMMARY

This disclosure relates to interpolation systems and methods for a digital-to-analog converter (e.g., a gamma bus generator) to enhance the smoothness of its output.

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

To display an image, an electronic display generally controls light emission (e.g., luminance and/or color) of its display pixels based on corresponding image data. For example, an image data source may output image data as a stream of pixel data that indicates target luminance of display pixels located at a corresponding pixel positions. In some embodiments, image data may indicate target luminance per color component (e.g., a gray level for each color component), for example, via red component image data, blue component image data, and green component image data. Additionally or alternatively, image data may indicate target luminance in grayscale.

Current may be supplied by a gamma bus generator to drivers of display pixels at various analog voltage levels to achieve the desired luminance values (e.g., gray levels for each color component). For example, in some embodiments, the different voltage levels may be achieved via one or more digital to analog converters (DACs), amplifiers, and/or a resistor string. In some scenarios, the gamma bus may not provide the voltage levels associated with every gray level. Instead, the gamma bus may provide analog reference voltages that correspond to some but not all gray levels. In some embodiments, providing only a portion (e.g., the analog reference voltages) of the total analog voltage levels associated with the gamut of gray levels may reduce power consumption of the gamma bus generator, reduce the size of the gamma bus generator, and/or decrease the footprint of the data lines (e.g., gamma bus) carrying the analog voltages. As such, interpolation circuitry may be included, such as with the source amplifiers of the electronic display, to generate intermediate analog voltages (e.g., voltages between the analog reference voltages of the gamma bus) to make available a full range of analog voltage levels associated with a gamut of gray levels for driving the display pixels.

Additionally, in some embodiments, the interpolation circuitry may perform different levels of interpolation based on which gray level is desired. For example, in some embodiments, certain intermediate analog voltages may be determined by interpolating between two analog reference voltages having immediate proximity (e.g., in the range of discrete analog voltage levels) to the intermediate analog voltage. In other words, two analog reference voltages associated with gray levels (e.g., gray levels 5 and 7) immediately adjacent a desired gray level (e.g., gray levels 6) may be interpolated between to generate the intermediate analog voltage associated with the desired gray level (e.g., gray level 6). However, other desired gray levels may be interpolated at higher levels of interpolation. For example, in some embodiments, multiple different intermediate voltages having different desired gray levels (e.g., gray levels 64-66) may be interpolated based on the same two analog reference voltages having gray levels (e.g., gray levels 63 and 67) surrounding the multiple different intermediate voltages. In other words, the span of gray levels between tap points of the gamma bus (e.g., the analog reference voltages) may vary. In some embodiments, the level of interpolation may vary based on a likelihood of perceivable artifacts. For example, at lower gray levels (e.g., darker gray levels), where error in the gray level may have a more perceivable effect, a lower level interpolation may be used to increase the accuracy of the interpolation and reduce the likelihood of perceivable artifacts and increase smoothness of the transitions between gray levels. On the other hand, at higher gray levels (e.g., brighter gray levels), where error in the gray level may be less perceivable, a higher level interpolation may be used to save space, power, and/or additional resources. As should be appreciated, the number of gray levels, tap points, and/or which analog reference voltages are used to interpolate which intermediate voltages are given as examples and are non-limiting.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
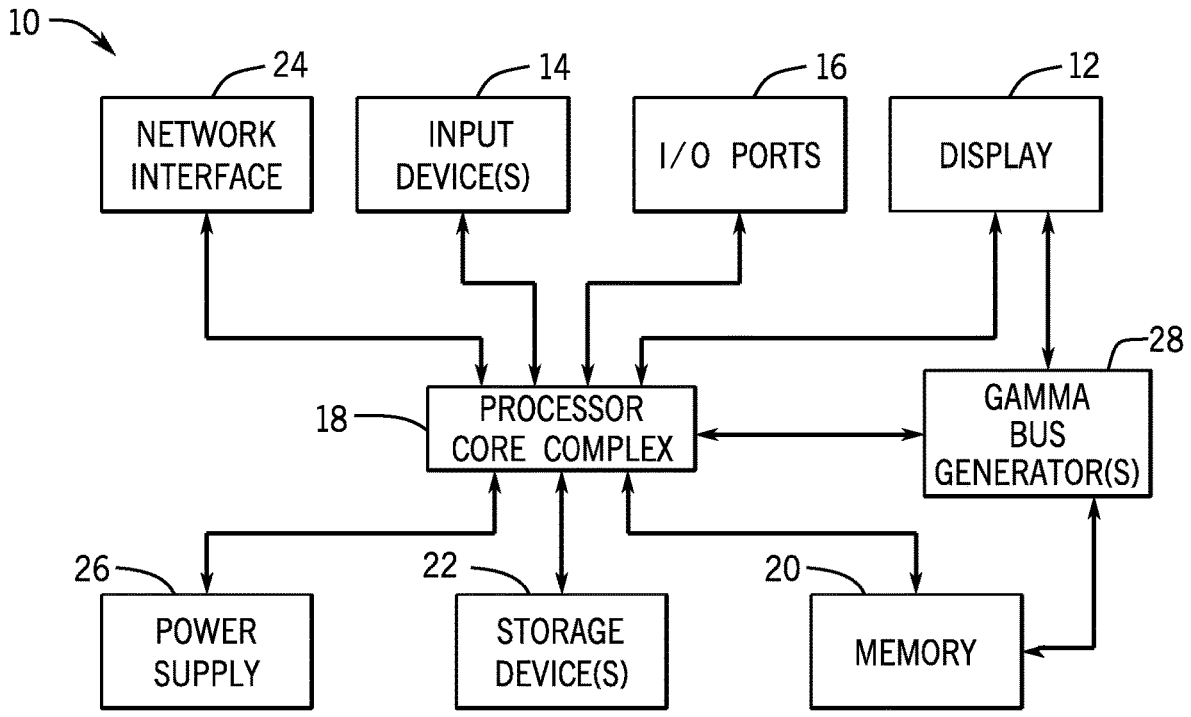
FIG. 1 is a block diagram of an electronic device that includes an electronic display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic devices such as computers, mobile phones, portable media devices, tablets, televisions, virtual-reality headsets, and vehicle dashboards, among many others, often use one or more electronic displays to present information via one or more images (e.g., image frames). Such electronic displays may take the form of a liquid crystal display (LCD), a light emitting diode (LED) display, an organic light emitting diode (OLED) display, a plasma display, or the like. In any case, to display an image, the electronic display generally controls light emission (e.g., luminance and/or color) of its display pixels based on corresponding image data. For example, an image data source (e.g., memory, an input/output (I/O) port, and/or a communication network) may output image data as a stream of pixel data that indicates target luminance of display pixels located at a corresponding pixel positions. In some embodiments, image data may indicate target luminance per color component, (e.g., a gray level for each color component), for example, via red component image data, blue component image data, and green component image data. Additionally or alternatively, image data may indicate target luminance in grayscale.

Digital values of the image data may be mapped to analog voltages to drive each of the display pixels at a target luminance level. For example, in some embodiments, the different voltage levels may be achieved via one or more digital to analog converters (DACs), amplifiers, and/or a resistor string of a gamma bus generator. In some embodiments, the gamma bus generator may output multiple different voltage levels corresponding to the digital values of the image data. For example, 8-bit image data per color component may correspond to a gamut of 256 different gray levels and, therefore, 256 different voltage levels per color component. As should be appreciated, the image data and corresponding voltage outputs may be associated with any suitable bit-depth and gray level values depending on implementation and the electronic display. Furthermore, the gamma bus generator may include more or fewer voltage outputs than the corresponding bit-depth of image data. For example, in some embodiments, the same voltage level may be used for multiple gray levels, and the current may be pulse-width modulated to obtain the different perceived luminance outputs.

Current may be supplied to the display pixels at various voltage levels generated by a gamma bus generator to achieve the desired luminance values (e.g., gray levels for each color component). In some scenarios, however, the gamma bus may not provide the voltage levels associated with every gray level. Instead, the gamma bus may provide analog reference voltages that correspond to some but not all gray levels. In some embodiments, providing only a portion of the total analog voltage levels associated with the gamut of gray levels may reduce power consumption of the gamma bus generator, reduce the size of the gamma bus generator, and/or decrease the footprint of the data lines (e.g., gamma bus) carrying the analog voltages. As such, interpolation circuitry may be included, such as with the source amplifiers of the electronic display, to generate intermediate analog voltages (e.g., voltages between the analog reference voltages of the gamma bus) to make available a full gamut of analog voltages for driving the display pixels.

Additionally, in some embodiments, the interpolation circuitry may perform different levels of interpolation based on which gray level is desired. For example, in some embodiments, certain intermediate analog voltages may be determined by interpolating between two analog reference voltages having immediate proximity to the intermediate analog voltage. In other words, two analog reference voltages associated with gray levels (e.g., gray levels 5 and 7) immediately adjacent a desired gray level (e.g., gray levels 6) may be interpolated between to generate the intermediate analog voltage associated with the desired gray level (e.g., gray level 6). However, other desired gray levels may be interpolated at higher levels of interpolation. For example, in some embodiments, multiple different intermediate voltages having different desired gray levels (e.g., gray levels 64-66) may be interpolated based on the same two analog reference voltages having gray levels (e.g., gray levels 63 and 67) surrounding the multiple different intermediate voltages. In other words, the span of gray levels between tap points of the gamma bus (e.g., the analog reference voltages) may vary. In some embodiments, the level of interpolation may vary based on a likelihood of perceivable artifacts. For example, at lower gray levels (e.g., darker gray levels), where error in the gray level may have a more perceivable effect, a lower level interpolation may be used to increase the accuracy of the interpolation, reduce the likelihood of perceivable artifacts, and increase the smoothness of the transitions between gray levels. On the other hand, at higher gray levels (e.g., lighter gray levels), where error in the gray level may be less perceivable, a higher level interpolation may be used to save space, power, and/or additional resources. As should be appreciated, the number of gray levels, tap points, and/or which analog reference voltages are used to interpolate certain intermediate voltages as discussed herein are given as examples and are non-limiting. Furthermore, although discussed herein as relating to interpolation of analog voltages for use in an electronic display panel, the techniques discussed herein may be applicable to additional scenarios where interpolation of analog voltages is of interest. For example, audio reproduction may have different sensitivities to the precision/accuracy of different analog voltages, and as such the different analog voltages may be interpolated differently.

To help illustrate, an electronic device 10, which includes an electronic display 12, is shown in FIG. 1. As will be described in more detail below, the electronic device 10 may be any suitable electronic device 10, such as a computer, a mobile phone, a portable media device, a tablet, a television, a virtual-reality headset, a vehicle dashboard, and the like. Thus, it should be noted that FIG. 1 is merely one example of a particular implementation and is intended to illustrate the types of components that may be present in an electronic device 10.

The electronic device 10 may include the electronic display 12, one or more input devices 14, one or more input/output (I/O) ports 16, a processor core complex 18 having one or more processor(s) or processor cores, local memory 20, a main memory storage device 22, a network interface 24, a power source 26, and one or more gamma bus generators 28 coupled to one or more respective gamma buses. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the gamma bus generator 28 may be included in the electronic display 12, such as part of a display driver, or implemented separately.

The processor core complex 18 may be operably coupled with local memory 20 and the main memory storage device 22. Thus, the processor core complex 18 may execute instruction stored in local memory 20 and/or the main memory storage device 22 to perform operations, such as generating and/or transmitting image data. As such, the processor core complex 18 may include one or more general purpose microprocessors, one or more application specific integrated circuits (ASICs), one or more field programmable logic arrays (FPGAs), or any combination thereof.

In addition to instructions, the local memory 20 and/or the main memory storage device 22 may store data to be processed by the processor core complex 18. Thus, in some embodiments, the local memory 20 and/or the main memory storage device 22 may include one or more tangible, non-transitory, computer-readable mediums. For example, the local memory 20 may include random access memory (RAM) and the main memory storage device 22 may include read only memory (ROM), rewritable non-volatile memory such as flash memory, hard drives, optical discs, and/or the like.

In some embodiments, the network interface 24 may facilitate data communication with another electronic device and/or a communication network. For example, the network interface 24 (e.g., a radio frequency system) may enable the electronic device 10 to communicatively couple to a personal area network (PAN), such as a Bluetooth network, a local area network (LAN), such as an 802.11x Wi-Fi network, and/or a wide area network (WAN), such as a 4G or LTE cellular network.

In some embodiments, the power source 26 may provide electrical power to one or more components in the electronic device 10, such as the processor core complex 18, the electronic display 12, and/or the gamma bus generator 28. Thus, the power source 26 may include any suitable source of energy, such as a rechargeable lithium polymer (Li-poly) battery and/or an alternating current (AC) power converter.

Furthermore, in some embodiments, I/O ports 16 may enable the electronic device 10 to interface with other electronic devices. For example, when a portable storage device, computing system, and/or accessory is connected, the I/O port 16 may enable the processor core complex 18 to communicate data with the portable storage device, computing system and/or accessory.

In some embodiments, an input device 14 may facilitate user interaction with the electronic device 10, for example, by receiving user inputs. Thus, an input device 14 may include a button, a keyboard, a mouse, a trackpad, and/or the like. Additionally, in some embodiments, an input device 14 may include touch-sensing components in the electronic display 12. In such embodiments, the touch sensing components may receive user inputs by detecting occurrence and/or position of an object touching the surface of the electronic display 12.

In addition to enabling user inputs, the electronic display 12 may include a display panel with one or more display pixels. The electronic display 12 may control light emission from its display pixels (e.g., via the gamma bus generator 28) to present visual representations of information, such as a graphical user interface (GUI) of an operating system, an application interface, a still image, or video content, by displaying frames based at least in part on corresponding image data (e.g., pixel data corresponding to individual pixel positions).

The electronic display 12 may be operably coupled to the processor core complex 18 and the gamma bus generator 28. In this manner, the electronic display 12 may display images based at least in part on image data received from an image data source, such as the processor core complex 18 and/or the network interface 24, an input device 14, and/or an I/O port 16. To facilitate accurately representing an image, image data may be processed before being supplied to the electronic display 12, for example, via a display pipeline implemented in the processor core complex 18 and/or image processing circuitry.

The display pipeline may perform various processing operations, such as spatial dithering, temporal dithering, pixel color-space conversion, luminance determination, luminance optimization, image scaling, and/or the like. Based on the image data from the image data source and/or processed image data from the display pipeline, target luminance values for each display pixel may be determined. Moreover, the target luminance values may be mapped to analog voltage values (e.g., generated by the gamma bus generator 28), and the analog voltage value corresponding to the target luminance for a display pixel at a particular location may be applied to that display pixel to facilitate the desired luminance output from the display. For example, a first display pixel desired to be at a lower luminance output may have a lower voltage applied than a second display pixel desired to be at a higher luminance output.

Figure 2:
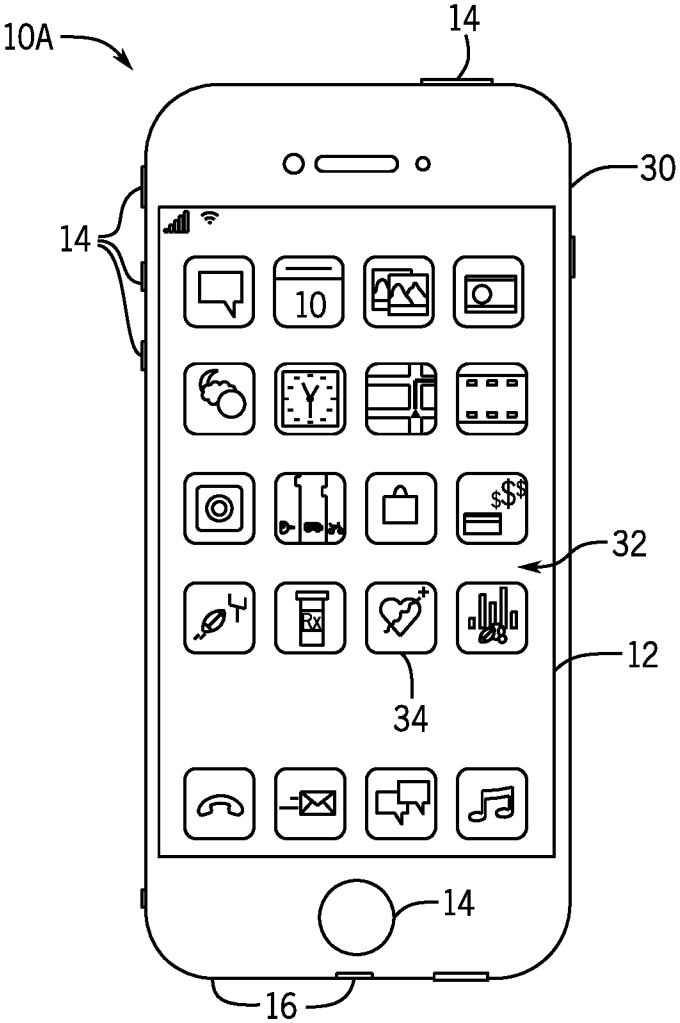
FIG. 2 is an example of the electronic device of FIG. 1, in accordance with an embodiment.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For illustrative purposes, the handheld device 10A may be a smart phone, such as any iPhone® model available from Apple Inc.

The handheld device 10A may include an enclosure 30 (e.g., housing) to protect interior components from physical damage and/or shield them from electromagnetic interference. Additionally, the enclosure 30 may surround the electronic display 12. In the depicted embodiment, the electronic display 12 is displaying a graphical user interface (GUI) 32 having an array of icons 34. By way of example, when an icon 34 is selected either by an input device 14 or a touch-sensing component of the electronic display 12, an application program may launch.

Furthermore, input devices 14 and/or the I/O ports 16 may be accessed through openings in the enclosure 30. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes.

Figure 3:
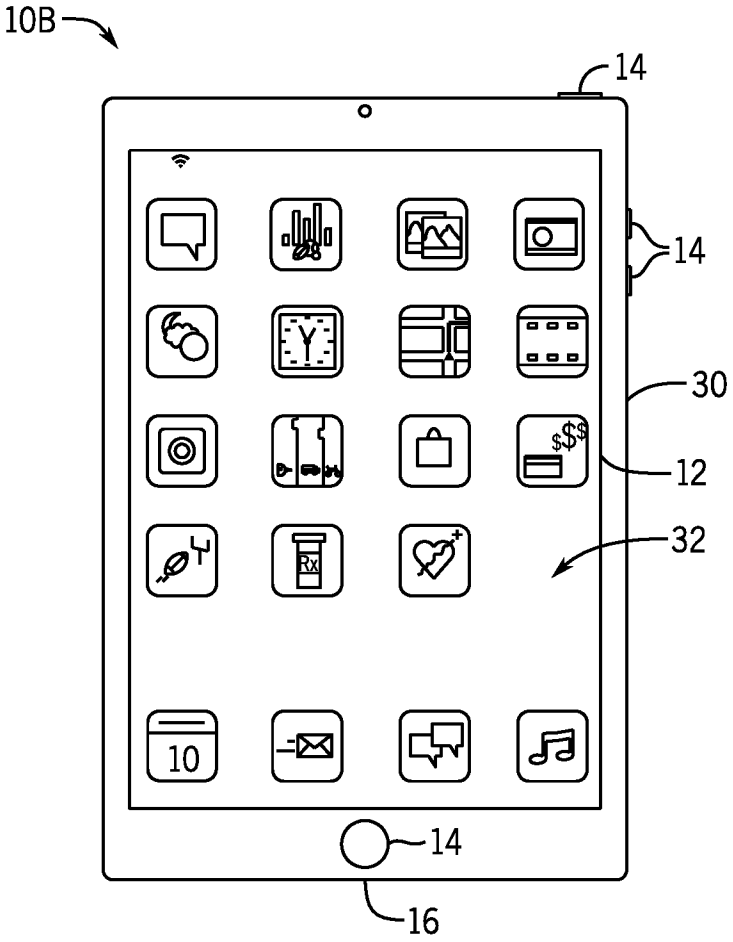
FIG. 3 is another example of the electronic device of FIG. 1, in accordance with an embodiment.
Figure 4:
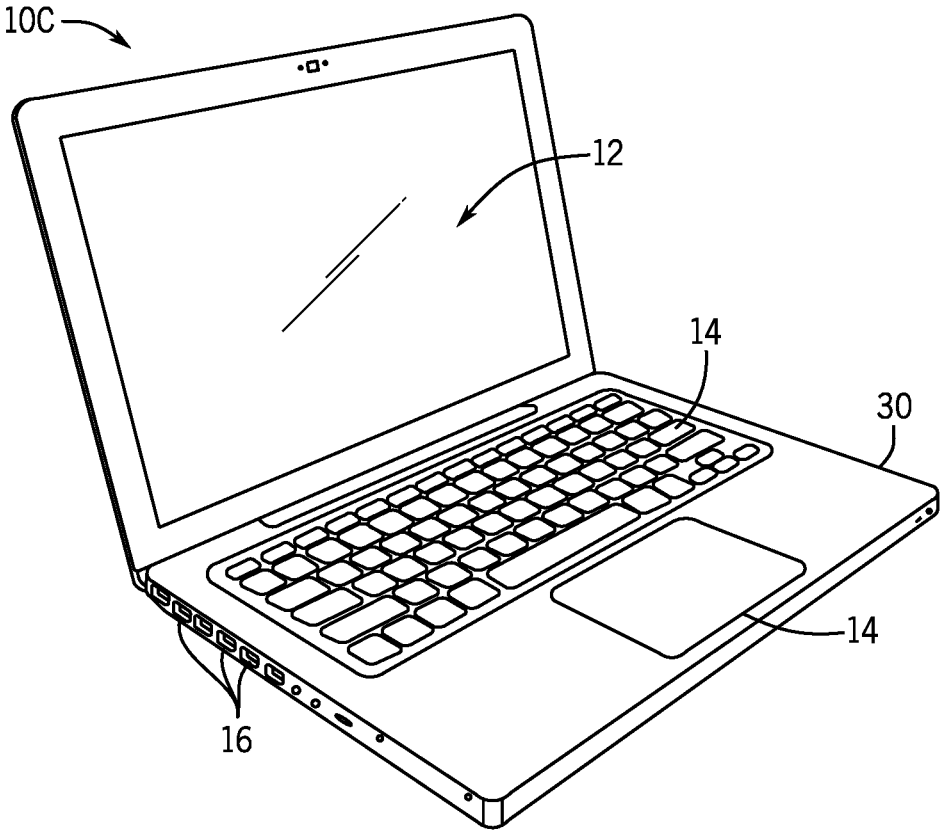
FIG. 4 is another example of the electronic device of FIG. 1, in accordance with an embodiment.
Figure 5:
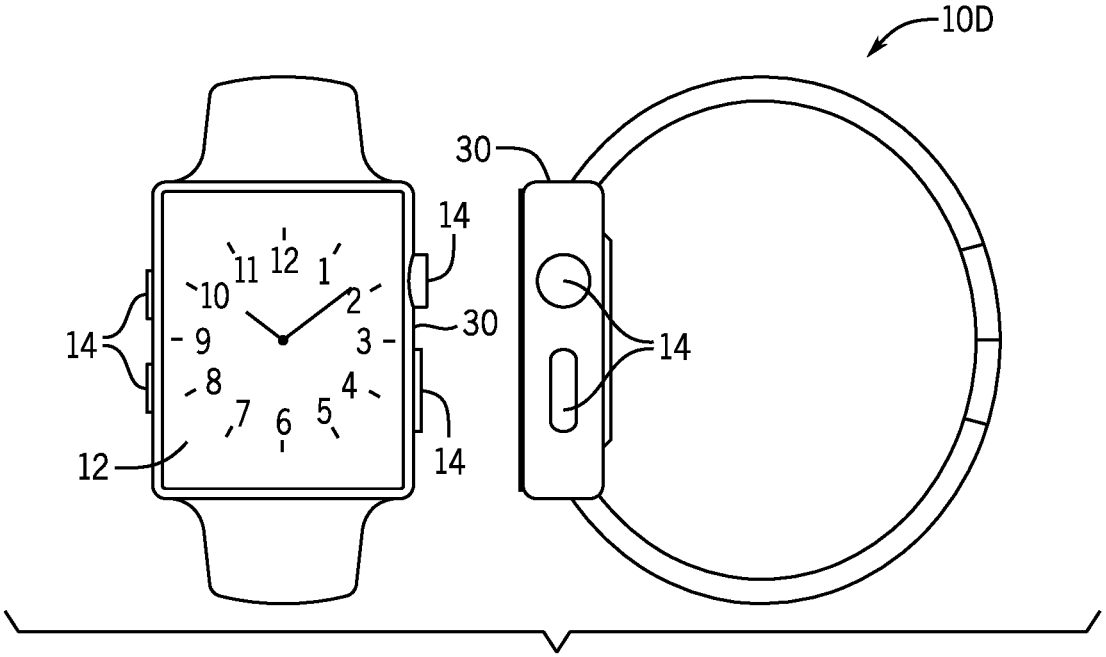
FIG. 5 is another example of the electronic device of FIG. 1, in accordance with an embodiment.

To further illustrate, another example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any Macbook® or iMac® model available from Apple Inc. Another example of a suitable electronic device 10, specifically a watch 10D, is shown in FIG. 5. For illustrative purposes, the watch 10D may be any Apple Watch® model available from Apple Inc. The tablet device 10B, the computer 10C, and/or the watch 10D each may also include an electronic display 12, input devices 14, I/O ports 16, and an enclosure 30.

Figure 6:
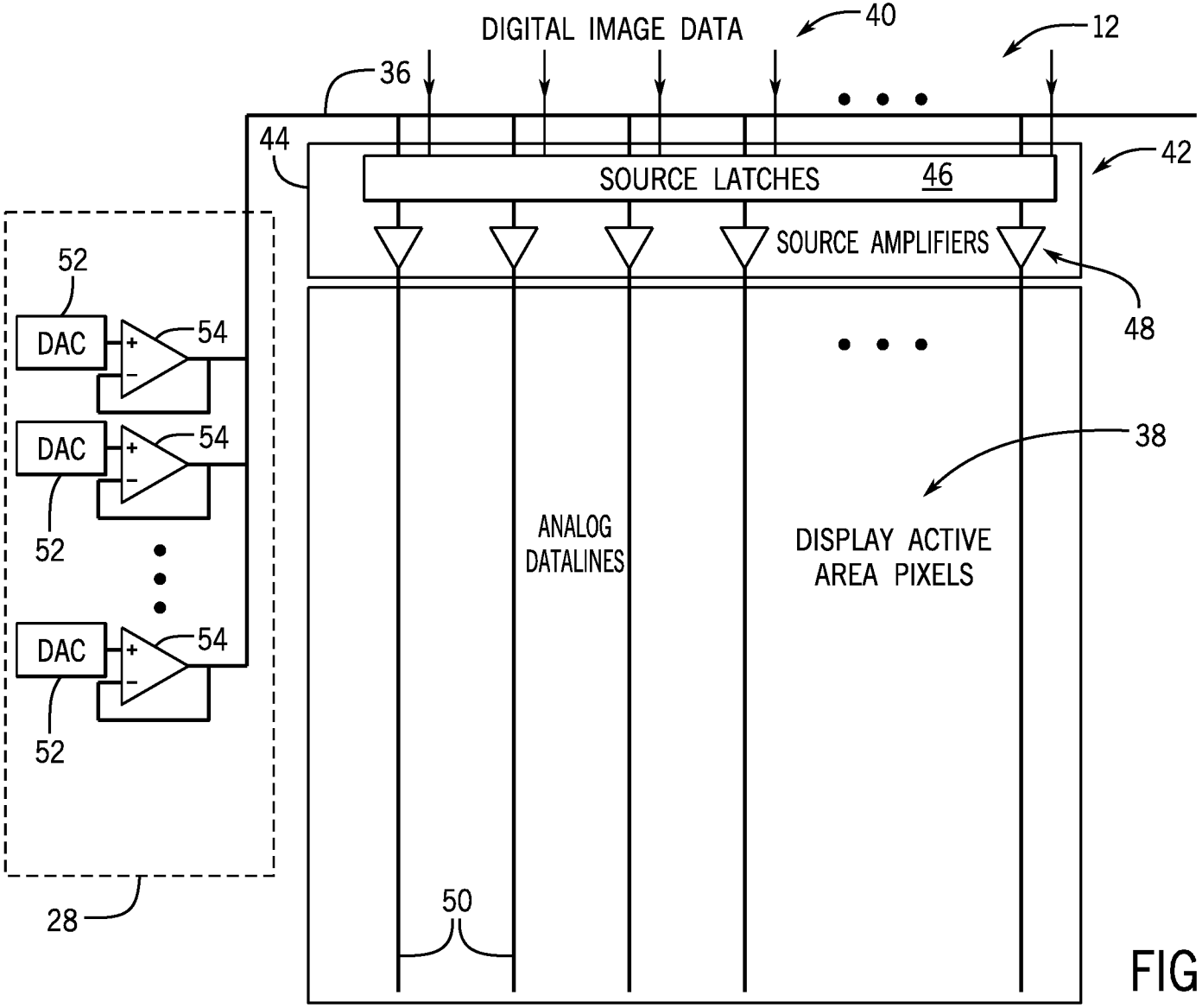
FIG. 6 is a diagrammatic representation of a gamma bus generator in electrical communication with an electronic display via a gamma bus, in accordance with an embodiment.

As described above, an electronic device 10 may utilize a gamma bus to provide a spectrum of analog reference voltages to the electronic display to facilitate illumination of the display pixels at target luminances. To help illustrate, a schematic diagram of a portion of the electronic device 10, including a gamma bus generator 28 and the electronic display 12 is shown in FIG. 6. As described in more detail below, the electronic device 10 may utilize one or more gamma bus generators 28 (e.g., a gamma bus generator 28 for each color component) and one or more respective gamma busses for transmitting analog reference voltages 36 to an electronic display 12. A single gamma bus generator 28 with a single gamma bus is discussed herein for brevity.

In some embodiments, the electronic display 12 may use analog reference voltages 36 to power display pixels 38 at various voltages that correspond to different luminance levels. For example, digital image data 40 may correspond to original or processed image data and contain target luminance values for each display pixel 38 in an active area of the electronic display 12. Moreover, display circuitry 42, such as column drivers 44, also known as data drivers and/or display drivers, may include source latches 46, source amplifiers 48, and/or any other suitable logic/circuitry to utilize the appropriate analog reference voltage(s) 36, based on the digital image data 40. The display circuitry 42 may apply power at the corresponding voltage to the display pixel 38 to achieve the target luminance output from the display pixel 38. Such power, at the appropriate voltage for each display pixel 38, may travel down analog datalines 50 to display pixels 38 of the active area. As should be appreciated, the active area of the electronic display 12 may be all or a portion of the electronic display 12 utilized to display an image.

As discussed above, the different analog reference voltages 36 supplied by the gamma bus may correspond to at least a portion of the values of the digital image data 40. For example, 8-bit digital image data 40 per color component may correspond to 256 different gray levels and, therefore, 256 different analog voltages per color component. Further, digital image data 40 corresponding to 8-bits per color component may yield millions or billions of color combinations as well as define the brightness of the electronic display 12 for a given frame. As should be appreciated, the digital image data 40 and corresponding voltage outputs may be associated with any suitable bit-depth depending on implementation and/or may use any suitable color space (e.g., RBG (red/blue/green), sRBG, Adobe RGB, HSV (hue/saturation/value), YUV (luma/chroma/chroma), Rec. 2020, etc.). Furthermore, the gamma bus may include more or fewer analog reference voltages 36 than the corresponding bit-depth of digital image data 40. Indeed, in some embodiments, the same analog reference voltages 36 may be used for multiple gray levels, for example, via interpolation between analog reference voltages 36 and/or pulse-width modulated of current flow to obtain the different perceived luminance outputs. In some embodiments, the gamma bus generator 28 and/or display circuitry 42 may provide the display pixels with a negative voltage relative to a reference point (e.g., ground). As should be appreciated, the positive and negative voltages may be used in a similar manner to operate the display pixels 38, and they may have mirrored or different mappings between voltage level and target gray level.

Additionally, in some embodiments, different color components of display pixels 38 (e.g., a red sub-pixel, a green sub-pixel, a blue sub-pixel, etc.) may have different mappings between voltage level and target gray level. For example, display pixels 38 of different color components may have different luminance outputs given the same driving voltage/current. As such, in some embodiments, one or more gamma buses may be used for each color component and/or voltage polarity. As should be appreciated, the mappings between voltage level and target gray level may depend on the type of display pixels (e.g., LCD, LED, OLED, etc.), a brightness setting, a color hue setting, temperature, contrast control, pixel aging, etc., and, therefore, may depend on implementation.

The different analog reference voltages 36 may be generated by the gamma bus generator 28 via one or more DACs 52, amplifiers 54, and/or a resistor string (not shown). However, in some scenarios, the gamma bus generator 28 may not provide the entire range of voltage levels associated with the entire gamut of gray levels. Instead, the gamma bus generator 28 may provide analog reference voltages 36 that correspond to some, but not all, gray levels. In some embodiments, providing only a portion of the total range of analog voltage levels associated with the gamut of gray levels may reduce power consumption of the gamma bus generator 28, reduce the size of the gamma bus generator 28, and/or decrease the footprint of the gamma bus carrying the analog reference voltages 36.

To make available a satisfactory range (e.g., the full range, a subset of the full range that is being utilized in the current frame, or other subset of the full range) of discrete analog voltage levels for driving the display pixels 38, intermediate analog voltages (e.g., voltages between the analog reference voltages of the gamma bus) may be interpolated via interpolation circuitry. Furthermore, different intermediate analog voltages may be interpolated using different levels of interpolation to improve the smoothness of transitions (e.g., with reduced likelihood of visual artifacts) between gray levels, while maintaining a reduced number of analog reference voltages 36 that may help save space, power, and/or additional resources.

In some scenarios, the range of discrete analog voltage levels may have a non-linear (e.g., logarithmic, exponential, piecewise, etc.) relation with the gamut of gray levels. Moreover, the curvature (e.g., second derivative) of the relation may correspond to the smoothness of the perceived gray level transitions. As such, in some embodiments, the discrete positions (e.g., tap points) of the analog voltage levels may be selected to increase the perceived smoothness of transitions between gray levels by placing more tap points at locations where the curvature is greater (e.g., where voltage errors may have a higher likelihood of perceivable artifacts). Additionally, in some embodiments, different interpolations may be accomplished based on what gray level is associated with the analog voltage level being interpolated. For example, interpolations with less potential error may be performed where the curvature of the relation between analog voltage levels and gray levels is greater, and interpolations where error is less likely to be perceived and/or less error is likely to occur may utilize less resource intensive interpolations to increase efficiency (e.g., size efficiency, power efficiency, etc.).

Figure 7:
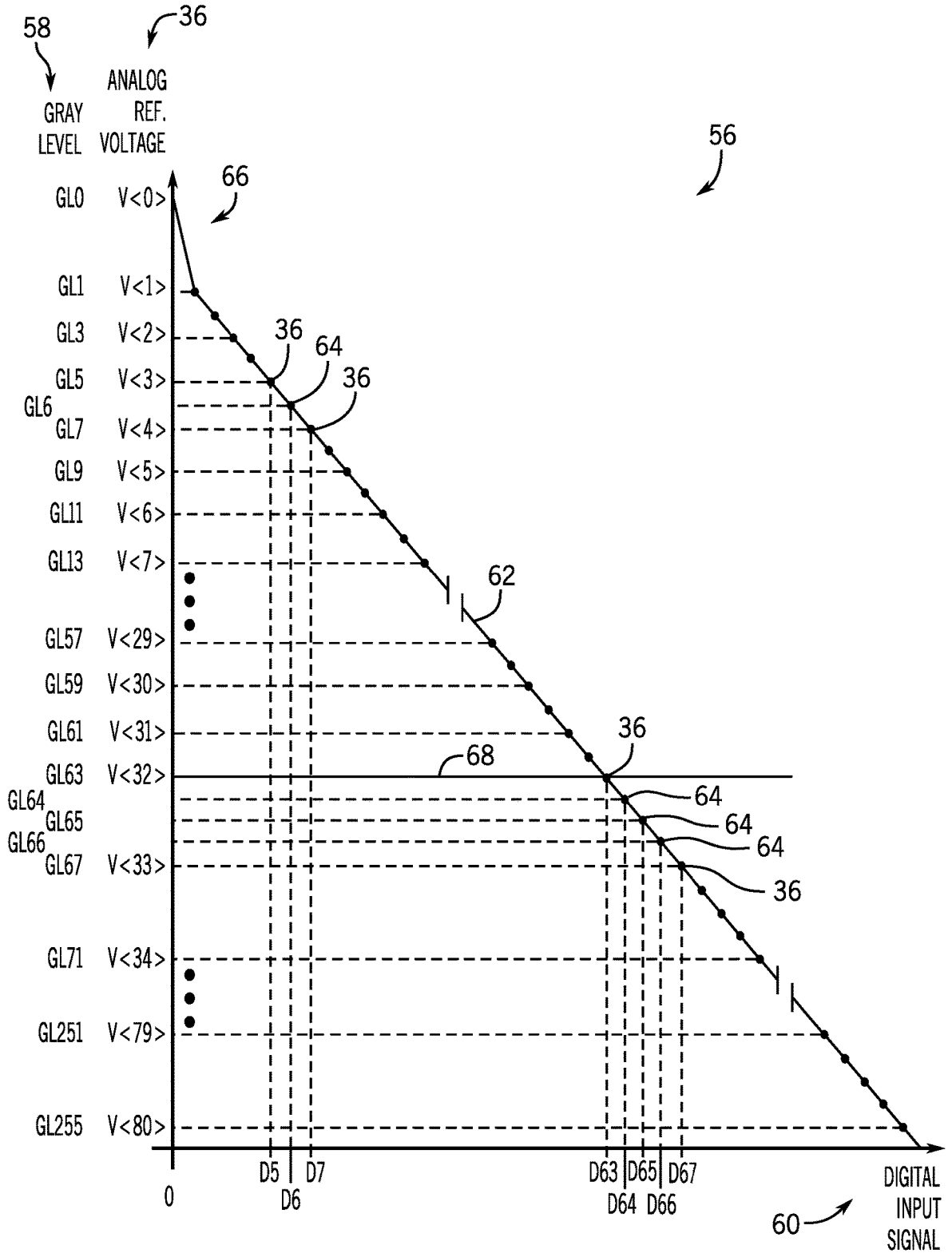
FIG. 7 is a graph of gray levels and corresponding digital input signals in relation to analog reference voltages of a gamma bus, in accordance with an embodiment.

To help illustrate, FIG. 7 is a graph 56 of gray levels 58 and corresponding digital input signals 60 in relation to the analog reference voltages 36 of the gamma bus. In the depicted example, the gray level 58 ranges from 0 to 255, corresponding to digital input signals 60 from 0 to 255, and the gamma bus provides 81 analog reference voltages 36. As should be appreciated, the graph 56 is shown as a non-limiting example, and the gamut of gray levels 58 and the number of analog reference voltages 36 may vary based on implementation. As depicted, certain gray levels 58 (e.g., GL5, GL7, GL 63, and GL 67) may be directly related to corresponding analog reference voltages 36 (e.g., V<3>, V<4>, V<32>, and V<33>, respectively). The range of the analog voltage levels 62 may include additional intermediate voltages 64 that do not have directly relating analog reference voltages 36 from the gamma bus. Furthermore, although shown as generally linear, the changes in analog voltage levels 62 from one gray level 58 to another may be non-linear (e.g., logarithmic, exponential, piecewise, etc.). For example, the voltage jump 66 in the analog voltage level 62 from GL0 to GL1 may be greater than the change in analog voltage level 62 from GL1 to GL2.

To generate the intermediate voltages 64 for gray levels 58 that are not directly associated with an analog reference voltage 36, analog reference voltages 36 for nearby gray levels 58 may be interpolated between using either linear or non-linear interpolation. For example, because GL6 does not have a directly associated analog reference voltage 36, the analog voltage levels 62 corresponding to GL5 and GL 7 may be used to generate the intermediate voltage 64 corresponding to GL6. In some embodiments, the interpolation may be generally linear, while the changes in analog voltage level 62 from one gray level 58 to the next may be non-linear. As such, gray levels 58 associated with analog voltage levels 62 where the concavity of the non-linear relation is greater may be interpolated differently from gray levels associated with analog voltage levels 62 where the concavity of the non-linear relation is less. Indeed, in some scenarios, closer initial interpolation points to the desired intermediate voltage 64 may result in reduced interpolation error, particularly at gray levels 58 associated with analog voltage levels 62 where the concavity of the non-linear relation is greater (e.g., at gray levels 58 where linear interpolation error may be greater and/or more likely to produce a perceivable artifact). Furthermore, while any set of analog reference voltages 36 may be used in interpolating the intermediate voltages 64, in some embodiments, it may be desirable to utilize the two most proximate analog reference voltages 36 for a given intermediate voltage 64.

Low level interpolation may utilize analog reference voltages 36 that are associated with gray levels 58 immediately proximate the gray level 58 to be interpolated. In the above example, the intermediate voltage 64 for GL6 is interpolated using analog reference voltages 36 (e.g., V<3> and V<4>) that are associated with immediately proximate gray levels 58 (e.g., GL5 and GL6). Such low level interpolation may decrease interpolation error and increase smoothness between gray levels 58. In some embodiments, the interpolation of each intermediate voltage 64 may be performed via low level interpolation.

In some scenarios, it may not be feasible to perform low level interpolation for each intermediate voltage 64. For example, in order to have an analog reference voltage 36 immediately proximate each intermediate voltage 64, the number of analog reference voltages 36 and associated data lines of the gamma bus may be increased and/or the number of gray levels 58 may be decreased, which, in turn, may decrease operational efficiency, take up more space within the electronic device 10, and/or decrease the color fidelity of the electronic display 12. As such, in some embodiments, interpolation at gray levels 58 where interpolation error may have an increased likelihood of producing a visual artifact (e.g., color blockiness, banding, decreased visual smoothness, visible lines between color transitions, etc.) may use lower level interpolation, and gray levels 58 where interpolation error may be less likely to result in perceivable artifacts may utilize higher level interpolation. For example, in some embodiments, low level interpolation may be utilized for gray levels 58 below a threshold 68 (e.g., darker than a threshold gray level or lower than a threshold voltage).

To utilize lower level interpolation while maintaining a reduced number of analog reference voltages 36, a portion of the analog voltage levels 62 may be interpolated using higher level interpolation. For example, gray levels 58 above a threshold (e.g., threshold 68) may be interpolated by analog reference voltages 36 that may not be immediately proximate the intermediate voltage 64. Higher level interpolation may utilize the same set (e.g., pair) of analog reference voltages 36 to interpolate multiple intermediate voltages 64. For example, each of the intermediate voltages 64 corresponding to GL64, GL65, and GL66 may be interpolated using analog reference voltages V<32> and V<33> corresponding to GL63 and GL67. In some embodiments, the portion of analog voltage levels 62 interpolated by higher level interpolation may correspond to gray levels 58 that are less likely to produce perceivable artifacts in response to interpolation errors such as brighter gray levels 58. In the depicted example, the high level interpolation utilizes two analog reference voltages 36 to interpolate three different intermediate voltages 64. However, a given set of analog reference voltages 36 may be used to interpolate any suitable number (e.g., one, two, three, five, seven, or more) of intermediate voltages 64 depending on the level of interpolation.

Figure 8:
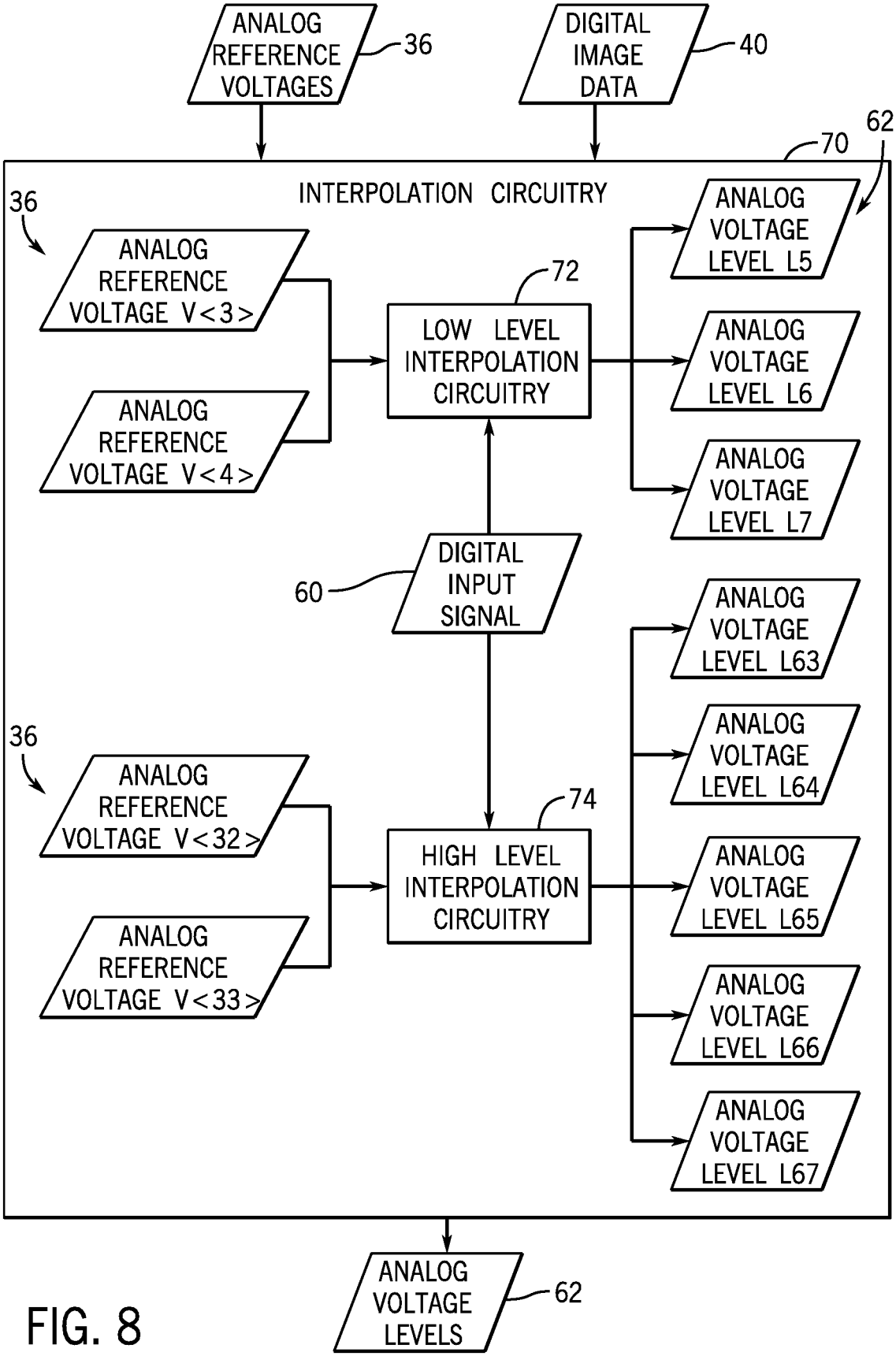
FIG. 8 is a block diagram of interpolation circuitry, in accordance with an embodiment.

As discussed above, it may be desirable to interpolate intermediate voltages 64 rather than generate the entire range of analog voltage levels 62 within the gamma bus generator 28. As such interpolation circuitry 70 may receive the analog reference voltages 36, generate the intermediate voltages 64 and output the analog voltage levels 62 to the display pixels 38, as shown in FIG. 8. In some embodiments, the interpolation circuitry 70 may include low level interpolation circuitry 72 and high level interpolation circuitry 74. Additionally or alternatively, the interpolation circuitry 70 may use the same circuitry for both low level interpolation circuitry 72 and high level interpolation circuitry 74, and the level of interpolation used may be based on the digital input signal 60 of the digital image data 40. For example, the low level interpolation circuitry 72 may be a subset of the high level interpolation circuitry 74 and/or include high level interpolation circuitry 74 operating in a low level interpolation mode. Moreover, the interpolation circuitry may use any suitable method of interpolation such as transistor-based interpolation (e.g., using differential pairs), switch-capacitor interpolation, resistor strings, etc. In some embodiments, the interpolation circuitry 70 may be disposed within the electronic display 12 such as within the display circuitry 42. Furthermore, in some embodiments, the interpolation circuitry 70 may be integrated with amplifiers such as the source amplifiers 48.

In some embodiments, the interpolation circuitry may interpolate each of the intermediate voltages 64 constantly such that the entire range of analog voltage levels 62 are constantly available during operation. However, in some embodiments, the interpolation circuitry 70 may interpolate the intermediate voltages 64 on demand in response to the digital image data 40, which may reduce the size of and/or increase the efficiency of the display circuitry 42. For example, in response to a digital input signal 60 representative of a particular gray level 58, the interpolation circuitry 70 may modulate between passing through an analog reference voltage 36 and interpolating and outputting an intermediate voltage 64. In some embodiments, the interpolation circuitry 70 may use the digital input signal 60, either fully or in part, to determine the applicable analog reference voltages 36 and the least significant bit(s) of the digital input signal 60 to determine interpolations.

When performing low level interpolation (e.g., via low level interpolation circuitry 72) the interpolation circuitry 70 may select the appropriate analog reference voltages 36 from which to interpolate the intermediate voltage 64 based on the digital input signal 60 or a portion (e.g., most significant bit(s)) thereof. Furthermore, in some embodiments, low level interpolation may use one or more bits (e.g., the least significant bit(s)) of the digital input signal 60 to decide whether to interpolate between the analog reference voltages 36 and return an intermediate voltage 64 or return one of the analog reference voltages 36. For example, in keeping with the example from FIG. 7, low level interpolation circuitry 72 may receive analog reference voltages 36, such as V<3> and V<4>, and have the ability to output the analog voltage levels 62 (e.g., L5, L6, and/or L7) associated with GL5, GL6, and/or GL7. Moreover, based on the digital input signal 60 (e.g., the least significant bit of the digital input signal 60), the low level interpolation circuitry 72 may determine whether to perform an interpolation and output the intermediate voltage 64 (e.g., L6 associated with GL6) or output one of the analog reference voltages 36 (e.g., V<3> or V<4> as L5 or L7, respectively).

Similarly, the high level interpolation circuitry 74 may utilize the digital input signal 60 to determine which analog reference voltages 36 are applicable, and two or more bits (e.g., two or more least significant bits) of the digital input signal to determine whether to interpolate an intermediate voltage 64 and, if so, which intermediate voltage 64 to generate. For example, the high level interpolation circuitry 74 may receive analog reference voltages 36, such as V<32> and V<33>, and have the ability to output the analog voltage levels 62, such as L63, L64, L65, L66, and/or L67 associated with GL63, GL64, GL65, GL 66, and/or GL67, respectively. The high level interpolation circuitry 74 may utilize two or more bits of the digital input signal 60 to determine whether to interpolate and, if so, which of the intermediate voltages 64 (e.g., the analog voltage levels 62 or L64, L65, or L66 associated with GL64, GL66, or GL67, respectively) to generate.

In some embodiments, common interpolation circuitry may be utilized for both low level interpolation and high level interpolation. For example, a portion of the digital input signal 60 may be used to determine whether to use low level interpolation or high level interpolation and the least significant bits of the digital input signal 60 may be used to modulate the output interpolation circuitry 70. Furthermore, even higher level interpolation may be accomplished using additional bits of the digital input signal 60. For example, the interpolation circuitry 70 may utilize three or more least significant bits of the digital input signal 60 to perform higher level interpolation having four or more intermediate voltages 64 between consecutive analog reference voltages 36.

Figure 9:
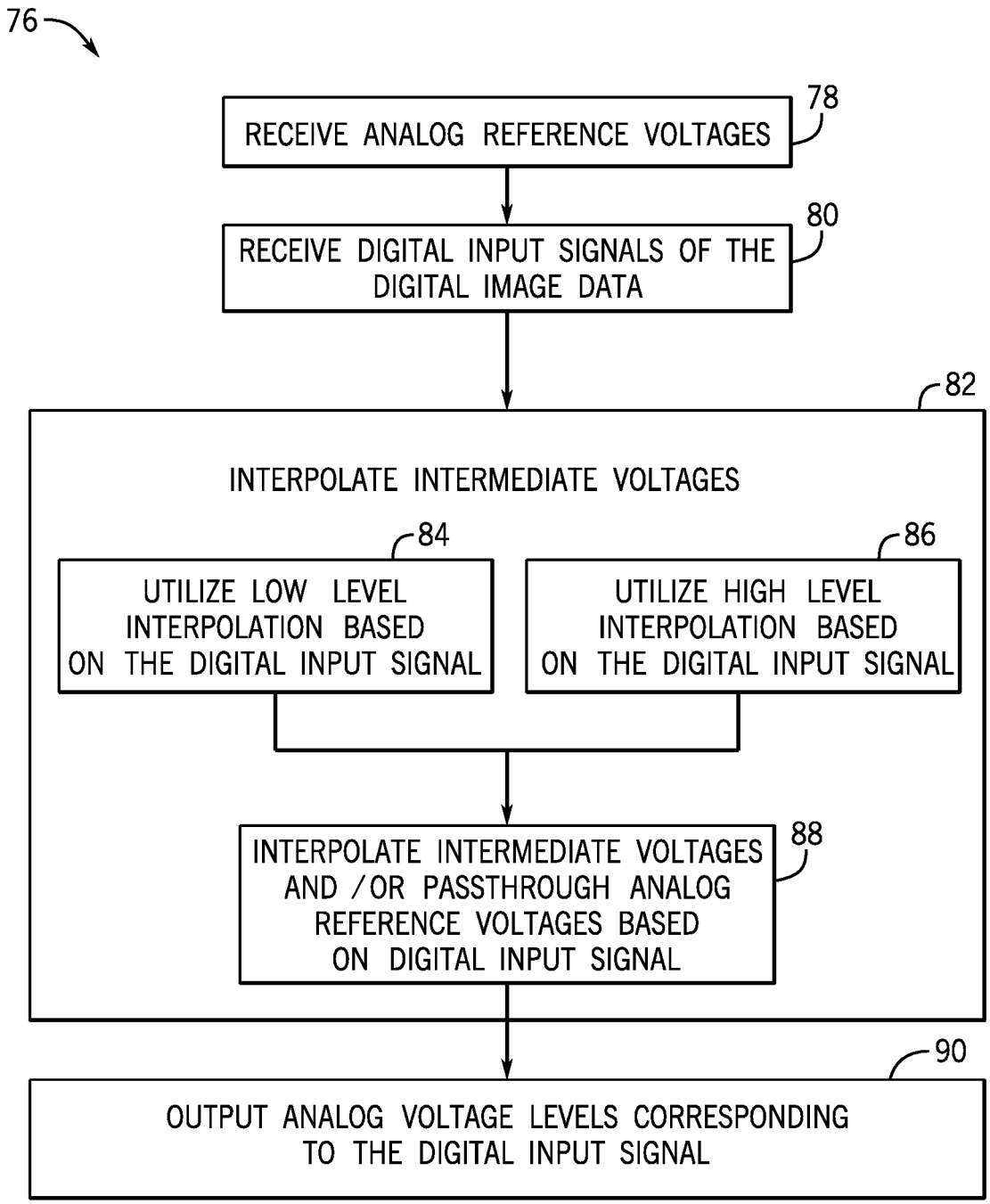
FIG. 9 is a flowchart of an example process for providing analog reference voltages to an electronic display, in accordance with an embodiment.

FIG. 9 is a flowchart 76 of an example process of the interpolation circuitry 70. The interpolation circuitry 70 may receive analog reference voltages 36 (process block 78) and digital input signals 60 of digital image data 40 (process block 80). The interpolation circuitry 70 may also interpolate intermediate voltages 64 (process block 82), for example, to provide analog voltage levels 62 not included in the analog reference voltages 36. Interpolating may include utilizing low level interpolation (process block 84) and/or utilizing high level interpolation (process block 86) based on the digital input signal 60. For example, low level interpolation may be utilized for gray levels 58 where interpolation error may be more likely to result in perceivable artifacts, and high level interpolation may be utilized for gray levels 58 where interpolation error may be less likely to result in perceivable artifacts. Using either low level or high level interpolation, the interpolation circuitry 70 may determine intermediate voltages 64 and/or passthrough analog reference voltages 36 based on the digital input signal 60 (process block 88). For example, the least significant bit(s) of the digital input signal 60 may be used to determine whether to interpolate an intermediate voltage 64 and/or which intermediate voltage 64 to generate. The analog voltage levels 62 corresponding to the digital input signal 60 may then be output (process block 90), for example, to the analog datalines 50 to the display pixels 38.

As discussed herein, the use of variable interpolation (e.g., via interpolation circuitry 70) along the gamut of gray levels 58 may help reduce the likelihood of perceivable artifacts, while increasing efficiency. For example, the increased accuracy of the interpolation may increase the smoothness of transitions between gray levels 58 where error in the gray level 58 may have a more perceivable effect. Further, where error in the gray level 58 may be less perceivable, a higher level interpolation may be used to save space, power, and/or additional resources. Moreover, although the above referenced flowchart 76 is shown in a given order, in certain embodiments, process blocks may be reordered, altered, merged, deleted, and/or occur simultaneously. Additionally, the referenced flowchart 76 is given as an illustrative tool and further decision and process blocks may also be added depending on implementation.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device comprising:

an electronic display panel comprising a plurality of display pixels configured to display an image based at least in part on a plurality of analog voltage signals; and interpolation circuitry configured to generate the plurality of analog voltage signals based at least in part on digital image data corresponding to the image and a threshold voltage, wherein the interpolation circuitry is configured to:

receive a plurality of analog reference voltages; and interpolate between sets of the plurality of analog reference voltages to generate a plurality of intermediate voltages, wherein the plurality of analog voltage signals comprises the plurality of intermediate voltages, wherein interpolating between the sets of the plurality of analog reference voltages comprises performing a first level interpolation of a first set of the plurality of analog reference voltages to generate a first intermediate voltage of the plurality of intermediate voltages and performing a second level interpolation of a second set of the plurality of analog reference voltages to generate a second intermediate voltage of the plurality of intermediate voltages, wherein the first level interpolation is different from the second level interpolation, wherein a third intermediate voltage of the plurality of intermediate voltages that is less than the threshold voltage is interpolated by the first level interpolation, wherein a fourth intermediate voltage of the plurality of intermediate voltages that is greater than the threshold voltage is interpolated by the second level interpolation, wherein the threshold voltage is set such that a first interpolation error of the third intermediate voltage has a higher probability to cause a perceivable artifact on the electronic display panel than a second interpolation error of the fourth intermediate voltage.

2. The electronic device of claim 1, wherein the first level interpolation comprises a low level interpolation and the second level interpolation comprises a high level interpolation.

3. The electronic device of claim 2, wherein the interpolation circuitry is configured to determine the low level interpolation based at least in part on a least significant bit of a first digital input signal of the digital image data, wherein the interpolation circuitry is configured to determine the high level interpolation based at least in part on two least significant bits of a second digital input signal of the digital image data.

4. The electronic device of claim 1, wherein the interpolation circuitry is configured to perform the first level interpolation to generate the first intermediate voltage in response to the digital image data corresponding to the first intermediate voltage being representative of a gray level less than a threshold gray level.

5. The electronic device of claim 4, wherein the threshold gray level corresponds to the threshold voltage.

6. The electronic device of claim 1, wherein the interpolation circuitry comprises:

low level interpolation circuitry configured to perform the first level interpolation; and high level interpolation circuitry different from the low level interpolation circuitry and configured to perform the second level interpolation.

7. The electronic device of claim 1, wherein the interpolation circuitry comprises a differential pair amplifier.

8. The electronic device of claim 1, comprising a gamma bus generator configured to generate the analog reference voltages.

9. The electronic device of claim 1, wherein the second set of the plurality of analog reference voltages consists of two different analog reference voltages, wherein the interpolation circuitry is configured to interpolate the second set of the plurality of analog reference voltages to generate a fifth intermediate voltage of the plurality of intermediate voltages.

10. The electronic device of claim 1, wherein the first set of the plurality of analog reference voltages comprises a first analog reference voltage, of the plurality of analog reference voltages, associated with a first gray level and a second analog reference voltage, of the plurality of analog reference voltages, associated with a second gray level, wherein the first intermediate voltage is associated with a third gray level between and immediately adjacent to the first gray level and the second gray level.

11. A method comprising:

receiving, via interpolation circuitry, a plurality of analog reference voltages;

receiving, via the interpolation circuitry, a first digital input signal representative of a first gray level of a discrete gamut of gray levels and a second digital input signal representative of a second gray level of the discrete gamut of gray levels;

performing, via the interpolation circuitry and in response to the first gray level being less than a threshold gray level, a first level interpolation between a first set of the plurality of analog reference voltages to generate a first intermediate voltage based at least in part on the first digital input signal, wherein performing the first level interpolation to generate the first intermediate voltage comprises performing interpolation between a first analog reference voltage of the first set of the plurality of analog reference voltages and a second analog reference voltage of the first set of the plurality of analog reference voltages, wherein the first analog reference voltage corresponds to a third gray level of the discrete gamut of gray levels and the second analog reference voltage corresponds to a fourth gray level of the discrete gamut of gray levels, wherein the first gray level is immediately proximate to both the third gray level and the fourth gray level;

performing, via the interpolation circuitry and in response to the second gray level being greater than the threshold gray level, a second level interpolation between a second set of the plurality of analog reference voltages to generate a second intermediate voltage based at least in part on the second digital input signal; and outputting, via the interpolation circuitry, the first intermediate voltage and the second intermediate voltage.

12. The method of claim 11, wherein performing the second level interpolation to generate the second intermediate voltage comprises performing interpolation between a third analog reference voltage of the second set of the plurality of analog reference voltages and a fourth analog reference voltage of the second set of the plurality of analog reference voltages, wherein the third analog reference voltage corresponds to a fifth gray level of the discrete gamut of gray levels and the fourth analog reference voltage corresponds to a sixth gray level of the discrete gamut of gray levels, wherein the second gray level is between the fifth gray level and the sixth gray level and the second gray level is not immediately proximate to both the fifth gray level and the sixth gray level.

13. The method of claim 11, comprising selecting the first set of the plurality of analog reference voltages to perform the first level interpolation based at least in part on the first digital input signal.

14. The method of claim 11, comprising determining whether to pass through an analog reference voltage of the first set of the plurality of analog reference voltages or perform the first level interpolation based at least in part on a least significant bit of the first digital input signal.

15. The method of claim 11, wherein the interpolation circuitry comprises a differential pair amplifier.

16. The method of claim 11, wherein the discrete gamut of gray levels comprises the threshold gray level.

17. Interpolation circuitry comprising:

low level interpolation circuitry configured to perform low level interpolation between a first plurality of sets of two analog reference voltages to generate a first plurality of intermediate voltages based at least in part on a threshold voltage, wherein the low level interpolation circuitry is configured to only generate one intermediate voltage per set of two analog reference voltages; and high level interpolation circuitry configured to perform high level interpolation, relative to the low level interpolation based at least in part on the threshold voltage, between a second plurality of sets of two analog reference voltages to generate a second plurality of intermediate voltages, wherein the high level interpolation circuitry is configured to generate at least two intermediate voltages per set of two analog reference voltages, wherein the first plurality of intermediate voltages are less than the threshold voltage, and the second plurality of intermediate voltages are greater than the threshold voltage.

18. The interpolation circuitry of claim 17, wherein the low level interpolation circuitry comprises at least a portion of the high level interpolation circuitry in a low level interpolation mode.

19. The interpolation circuitry of claim 17, wherein the low level interpolation circuitry, the high level interpolation circuitry, or both comprise a source amplifier configured to provide analog voltage levels to a plurality of display pixels of an electronic display.

20. The interpolation circuitry of claim 17, wherein the threshold voltage corresponds to a threshold gray level.

* * * * *